US009254447B2

(12) United States Patent
Checa

(10) Patent No.: US 9,254,447 B2
(45) Date of Patent: Feb. 9, 2016

(54) MIRROR MAZE WITH DYNAMIC ANIMATION FOR PROJECTION ONTO AN ARCH

(76) Inventor: René Aziz Checa, Col. Bosques de las Lomas (MX)

( * ) Notice: Subject to any disclaimer, the term of this patent is extended or adjusted under 35 U.S.C. 154(b) by 0 days.

(21) Appl. No.: 14/395,161

(22) PCT Filed: May 4, 2012

(86) PCT No.: PCT/MX2012/000048
§ 371 (c)(1),
(2), (4) Date: Oct. 17, 2014

(87) PCT Pub. No.: WO2013/165233
PCT Pub. Date: Nov. 7, 2013

(65) Prior Publication Data
US 2015/0105168 A1 Apr. 16, 2015

(51) Int. Cl.
*A63J 11/00* (2006.01)

(52) U.S. Cl.
CPC ..... *A63J 11/00* (2013.01)

(58) Field of Classification Search
CPC ..... A63J 11/00
See application file for complete search history.

(56) References Cited

U.S. PATENT DOCUMENTS 5,474,501 A * 12/1995 Teng ..... A63J 11/00 403/306
5,906,373 A * 5/1999 Sanders ..... A63B 67/00 273/349
6,095,927 A * 8/2000 Malone ..... A63J 11/00 472/128
6,398,659 B1 * 6/2002 Karg ..... A63J 11/00 160/135
7,749,087 B2 * 7/2010 Elias ..... A63J 11/00 472/62
2008/0205046 A1 8/2008 Elias
2009/0154760 A1 6/2009 Wang
2010/0277780 A1 11/2010 Elias
2010/0315725 A1 12/2010 Lin
2011/0310310 A1 12/2011 Lassila et al.

FOREIGN PATENT DOCUMENTS

CN 2465755 Y 12/2001
JP 2009006022 A 1/2009

(Continued)

OTHER PUBLICATIONS

Projection Mapping Door, Feb. 14, 2011, Retrieved from Internet http://www.youtube.com/watch?v=bsTJCyP-cnQ.
3D Projection Mapping Tutorial, May 23, 2011, Retrieved from Internet http://www.weltlighting.com/3d-video-mapping-projection-tutorial/.
Laberinto De Espejos, Feb. 1, 2011, Retrieved from Internet http://www.mirrormazes.com/.

(Continued)

*Primary Examiner* — Michael Dennis
(74) *Attorney, Agent, or Firm* — Schmeiser, Olsen & Watts, LLP

(57) ABSTRACT

The invention relates to a labyrinth of mirrors with elemental cells in the form of an equilateral triangle, each cell having at least one passage portal covered with opaque vinyl and at least one arch with a mirror forming a reflective obstacle. Each cell has a short-throw projector for projecting moving images with different designs or themes. The images are projected over the variable surface or contour of the passage portal which is covered with light opaque vinyl, the other two arches being covered with reflective vinyl or a mirror, as are the inner surfaces of the holding pillars or posts. The projection is defined by means of masks wherein the pixels outside the contour are covered in black or are rendered transparent, a technology called "projection mapping". In each cell, there is at least one opaque arch and two reflectors.

11 Claims, 5 Drawing Sheets

(56) References Cited

FOREIGN PATENT DOCUMENTS

| | | | |
|---|---|---|---|
| SK | 322008 | U1 | 8/2008 |
| WO | 2007121639 | A1 | 11/2007 |

OTHER PUBLICATIONS

International Search Report; PCT/MX2012/000048; International Filing Date: May 4, 2012; 2 pgs.

* cited by examiner

MIRROR MAZE WITH DYNAMIC ANIMATION FOR PROJECTION ONTO AN ARCH

CROSS-REFERENCE TO RELATED APPLICATION

This application claims priority to PCT Application No. PCT/MX2012/000048, having a filing date of May 4, 2012, the entire content of which is hereby incorporated by reference.

FIELD OF TECHNOLOGY

The following relates to the field of entertainment, more specifically to the use of mirrors arranged in triangular cells in order to create an illuminated maze with the dynamic illusion of straight passageways or infinite tunnels by means of the projection as a result of the mirrors, which are positioned on vertical supports arranged in basic cells forming triangles with internal angles of 60°.

BACKGROUND

The concept of a mirror maze dates back to 1649, when a wealthy Parisian citizen named Peter Stuyvesant visited the Hall of Mirrors in the palace of Versailles; he founded the House of Mirrors in Amsterdam in 1651.

The mirror maze is an attraction that creates repetitive images that confuse the spectator, where obstacles are created by combining support panels and mirrors embedded therein, and disorientation of the spectator is effected through repetition of the images in the arrangement of mirrors that are set up in cells at specific angles in order to form a basic cell comprised of three support panels and at least two mirrors. The frames or contours that hold the mirrors are imprinted with repetitive motifs in order to confuse the spectator even more, and in this manner to increase disorientation; this is the usual pattern of what is called a first-generation maze.

Second-generation mirror mazes utilize panels with imprinted arches and changes in lighting in the floor and ceiling of the basic cell with the purpose of creating a more intense experience by using a greater amount of visual stimuli.

United States patent application US 2011310310, published on Dec. 22, 2011, whose inventors are Lassila Neal et al., describes a system and method for multiple projection and framing of a lateral projection of a video on objects in a random fashion, wherein the data of the image are used to produce the framing of the projection on the object, and opaque projection surfaces and additional background surfaces are used to change the viewing angle.

Chinese patent CN 101923205, published on Dec. 22, 2010, whose inventor is Lai-Chang Lin, describes an optical system for wide-angle projection—in other words, the projection of lateral images or short throw images with very short effective focal length—which allows projection within narrow profiles with high image quality.

United States patent application US 2010277780, published on Nov. 4, 2010, whose inventor is Elias Darrin, describes an arrangement of mirrors disposed in a triangular prism shape on a revolving base supported on a vertical axis, wherein the mirror arrangement is used to increase the illusion created by the mirror maze per se; the arrangement has a zipping mechanism that facilitates the propulsion of the rotation axis, which in turn causes the mirror arrangement to revolve.

Taiwanese patent TW 200926840, published on Jun. 16, 2009, whose inventor is Wang Feng-Xing, describes an image-generating system in a maze, which projects a digital photograph and comprises an image-processing module that assigns flags to the photographs to be projected onto a platform.

Japanese patent JP 2009006022, published on Jan. 15, 2009, whose inventor is Nishi Nobuhiro, describes a mirror maze for amusement in which additional entertainment stations, such as slot machines, video game machines, and so on are integrated along the length of the tour. The entertainment stations are located in specific areas within the maze, and the spectator can decide if he would like to play an additional game during the tour.

United States patent application US 2008205046, published on Aug. 28, 2008, whose inventor is Elias Darrin, describes modifications to the lighting of a mirror maze with the traditional arrangement formed by support pillars and mirrors, wherein double lighting lines are positioned at the junction between two pillars that do not include a mirror, and a single lighting line is positioned in those that include a mirror in order to produce the appearance of a pair of lighting lines, that is, in the arch that allows the passage of the spectator and the one that constitutes an obstacle, respectively.

Slovak patent SK 322008, published on Aug. 5, 2008, whose inventor is Holy Peter, describes an inflatable maze for the entertainment of children at a party.

International patent application WO 2007121639, published on Nov. 1, 2007, whose inventor is Lai Ying-Kuang, describes a three-dimensional maze with an arrangement with several levels, in which the user can climb up or down in addition to circulate through each level. The maze is suitable for amusement during parties or in areas where large groups of people gather.

Chinese patent CN 2465755, published on Dec. 19, 2001, whose inventor is Shen Xingcun, describes a mirror maze that combines transparent glass panels that function as passages and as a generator of the image of the spectator through the additional mirrors located in the vicinity of the glass.

SUMMARY

An advantage is to provide a mirror maze for the projection of images onto an opaque surface in order to create the optical illusion of passages or infinite tunnels with animated contours by means of the projection.

Another advantage is to provide a mirror maze with lighting, projection of images, and sound, which changes in a dynamic fashion.

Yet another object of the invention advantage is to provide a mirror maze with cells formed by two arches with mirrors, whose support panel is covered with reflecting vinyl, wherein a projection is produced on an arch with an opaque panel that allows the passage of the spectator; said projection is created using a short throw projector located above said panel.

Yet another advantage is to provide a mirror maze in which a projection is exclusively produced on an opaque surface of the full passage arch of the cell without producing a shadow as the spectator passes.

It is also an advantage to provide a mirror maze in which opaque arches that follow the line of reflection of a light beam are distributed in order to create the illusion of infinite tunnels or infinite passageways in a straight line.

It is additionally an advantage to provide a mirror maze with triangular cells formed by flat panels with at least one passage, wherein one surface of the arch is opaque and has a central passage space in the shape of an arch, and the other two surfaces have at least one mirror and contours lined with reflecting vinyl, even the support columns, pillars, or posts of the panels of the cells.

It is a further advantage to provide a mirror maze wherein the placement of the projectors is arranged in such a way that it causes the illusion of passageways in a straight line with sounds and theme-related images with movement and sound.

BRIEF DESCRIPTION

Figure 4A:
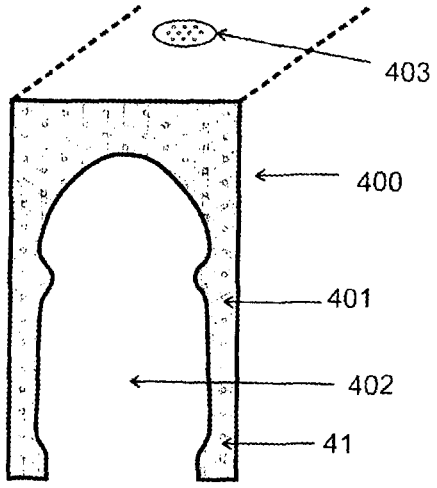

FIG. 4*a* shows a view of an arch according to the prior art in which lighting by means of LEDs is positioned overhead, and both faces of the contour of the arch are imprinted.

Figure 4B:
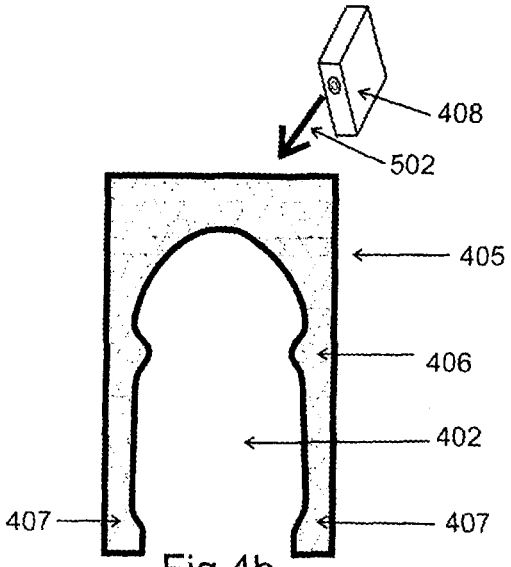

FIG. 4*b* shows a view of an arch according to the invention, whose contour is an opaque projection surface without impression, generally of pale or white color, and wherein the content of the video is projected by means of a short-throw projector located in the upper part of the arch.

Figure 5:
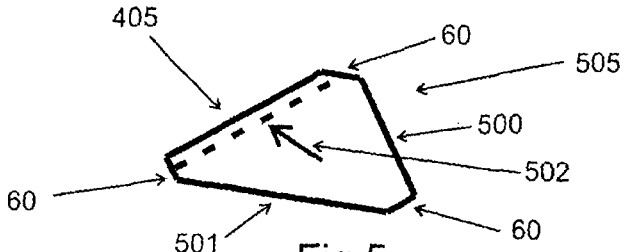

FIG. 5 shows a view of a basic cell with triangular shape having at least one projection arch or passage and a mirror in each of the opposite legs, whose contours are lined with reflecting vinyl; the cell is provided in addition with support pillars or posts in the vertices, which are also lined with reflecting vinyl or a mirror.

Figure 6:
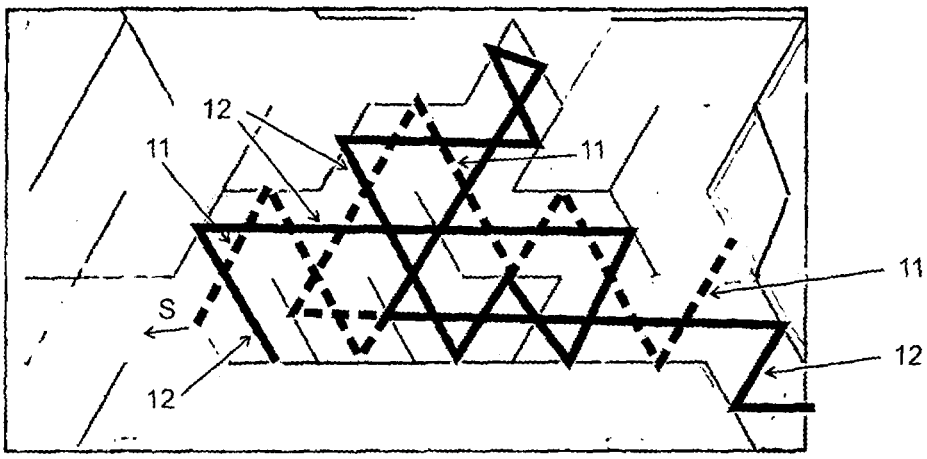

FIG. 6 shows two trajectories that follow the reflections in the triangular cells positioned at 60° angles to each other in order to determine the appropriate cells for the placement of one projector per cell in order to achieve the illumination and total reflection thereof.

Figure 7:
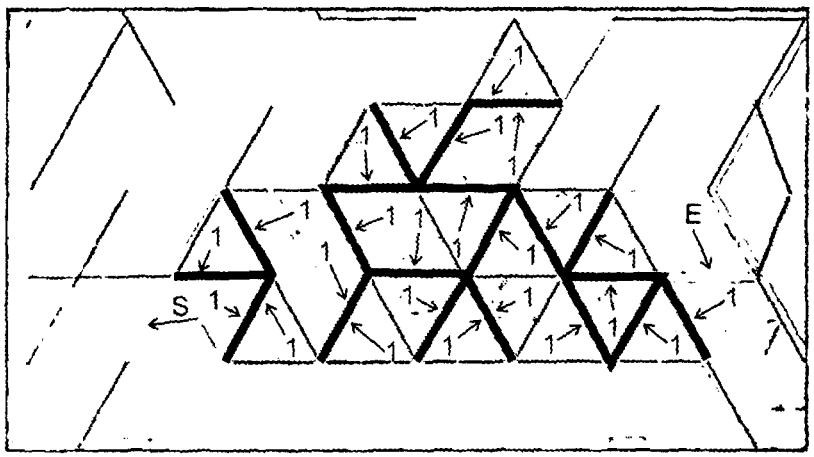

FIG. 7 shows the locations at which the projectors are placed, one per cell, over the path of the trajectory of the reflection.

Figure 8:
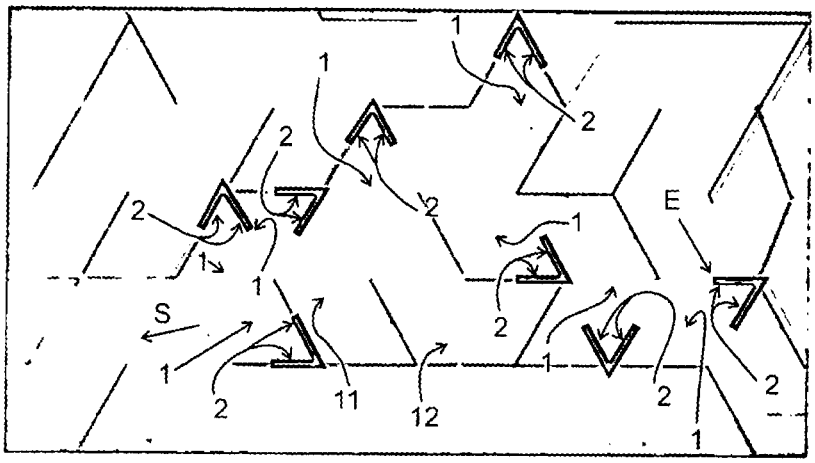

FIG. 8 shows a few locations at which the reflecting vinyl is positioned on the panels of the opposite legs of the illuminated cell by means of the dynamic projection emitted by the short-throw projector.

Figure 9:
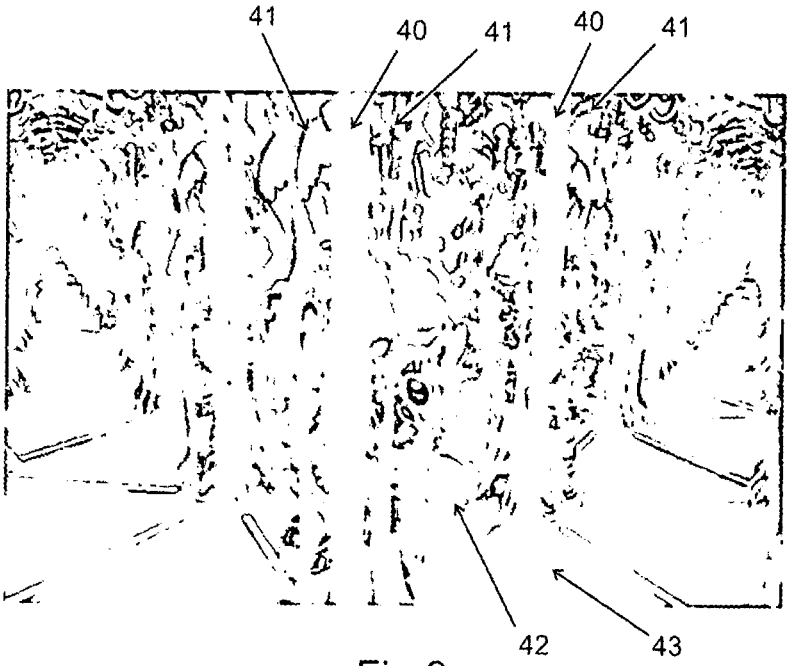

FIG. 9 shows an image of a maze according to the prior art, in which the lighting is positioned overhead and the contours of the arches are imprinted.

Figure 10:
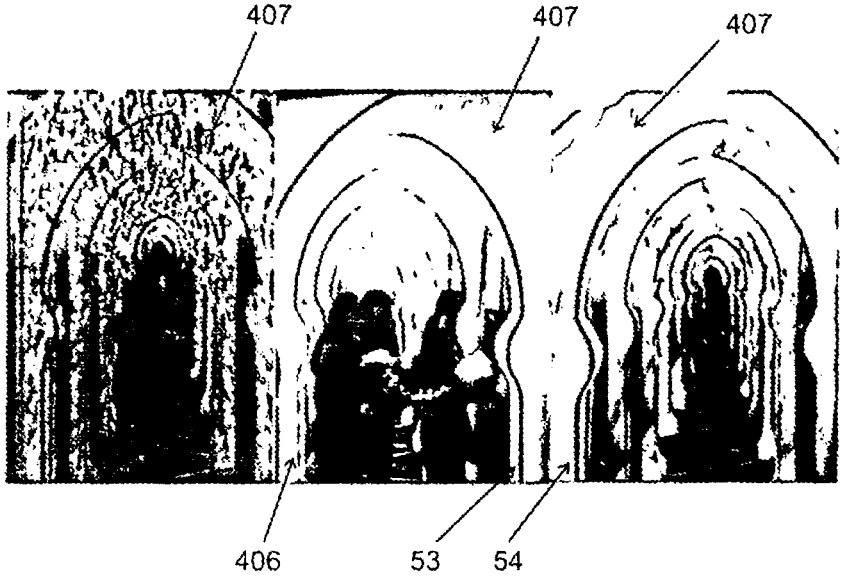

FIG. 10 shows three examples of animation projected over the contours of the arches of the maze, without the possibility of projecting a shadow produced by the spectator.

Figure 11:
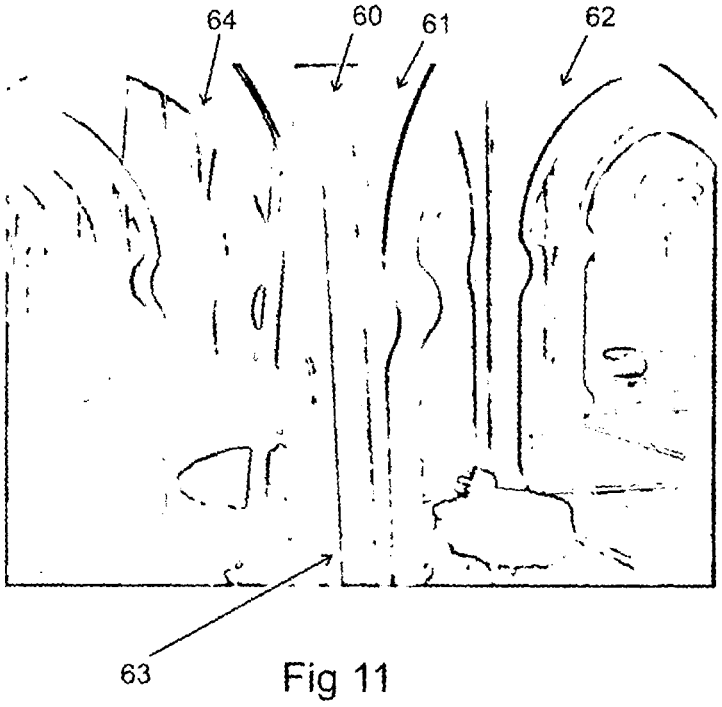

FIG. 11 shows the preparation of the surface of the contours of the arches over which the content of the video is projected delimited within the contour.

DETAILED DESCRIPTION

The application describes a mirror maze in the traditional arrangement of hexagons divided by mirrors placed in the opening or arch of the support panels, which in turn form basic cells in the shape of an equilateral triangle, which in turn are supported on pillars or posts placed in each vortex and center of the hexagon, thus forming basic triangular cells, wherein at least one support panel has a central opening section or arch that allows the passage of the spectator and has a flat edge on the sides and upper end and is positioned in order to imprint or project images; and wherein the projection or impression is effected without invading the area delimited for placement of the mirror or reflecting area, even the passage area or arch. The short-throw projector and the projection delimited within a specific contour of an object of random shape are of particular importance in the invention.

The video projectors allow the use of flexible screens, including vertical walls and panels, in order to display entertaining images, general information, product demonstrations, or other entertainment and informational content. The video projectors can be mounted on supports that are raised beyond reach, reducing the risk of accidental damage due to user neglect, thus protecting the projection equipment, which is generally expensive. In order to project a three-dimensional object, it is necessary to use two or more projectors with the same control and projecting the same image, which consequently increases the cost and complicates the implementation of the projection due to image interference and calibration errors.

It becomes necessary, as a consequence, to use a single delineated image and a single projector in order to obtain a high-quality image and overcome the mentioned disadvantages. The delineation of the image is effected through removing or making transparent all the pixels outside of the contour of the shape defined on the object.

Figure 1:
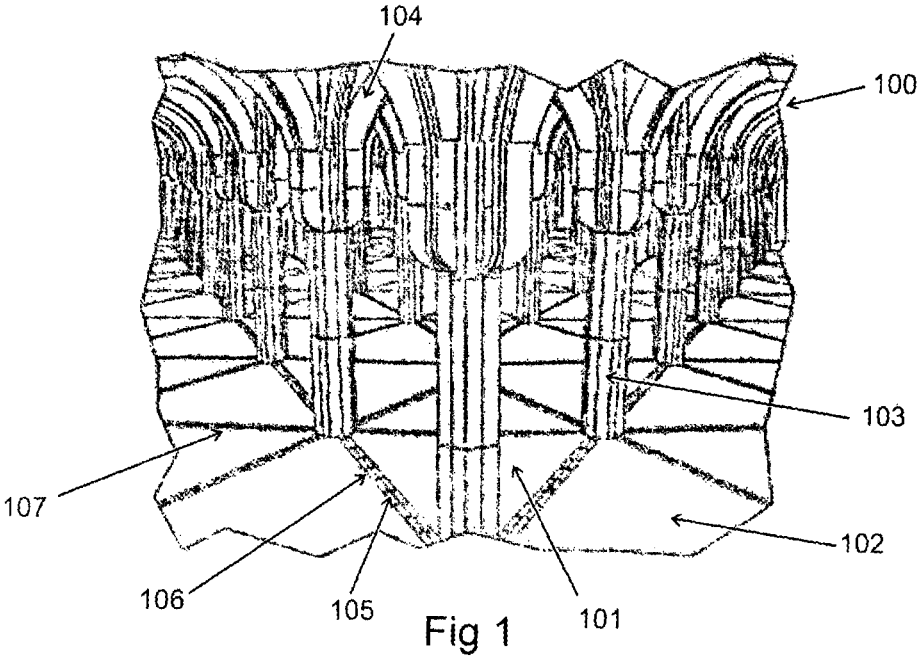
FIG. 1 shows a view of a mirror maze according to the prior art, whose triangular cells supported by pillars are illuminated in the floor by means of luminous strips that create the illusion of six luminous lines starting at one pillar, an arch without a mirror with two strips, and an arch with a mirror with a single luminous strip.

FIG. 1 shows a mirror maze (100) according to the prior art with lighting strips (105) in the floor (102) thereof, having a traditional arrangement of posts (103) and vertical panels in the arch (104) where mirrors are placed; some of these have openings or portals through which the spectator can pass. The lighting lines (105) with an array of lights (106) are positioned over the line (107) that joins the posts (103); the passage panels that do not have mirrors have double lighting lines, and the panels that are provided with a mirror (101) have only one lighting line, because the mirror reflects the latter, thereby creating the illusion of two lighting lines. The traditional illusion of this type of maze with cells shaped as equilateral triangles creates the illusion of an infinite number of straight passageways or tunnels and the appearance of six double lighting lines starting from each post.

Figure 2:
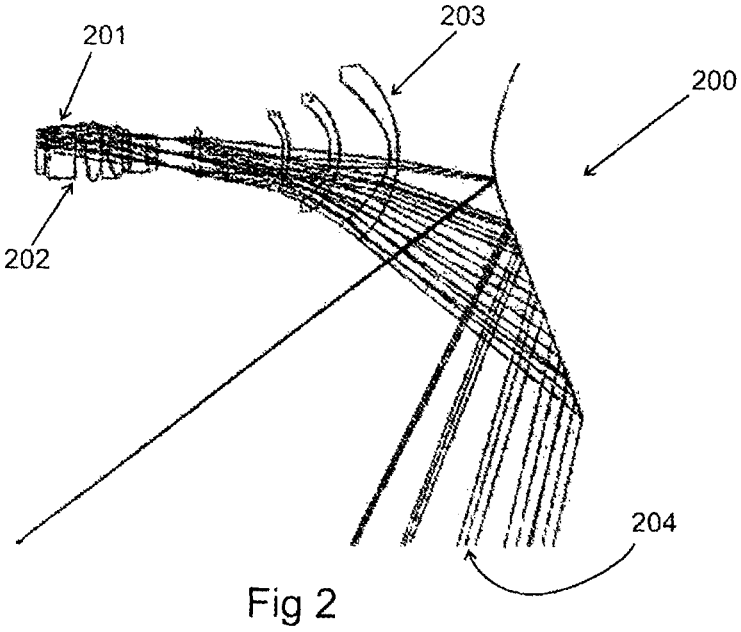
FIG. 2 shows a detail of an expanded beam path whose direction is suitably changed by means of a lens arrangement for oblique projection by means of a short throw projector, such as those used in this application.

FIG. 2 shows the operation with regard to the handling of the projection beam for a short-throw projector (200) according to the prior art, wherein the beam is subjected to the effect of a first lens section (202) that splits the initial beam into three beams, which then pass on to a second lens section (203) that splits said three beams in order to reflect them expanded and with a change of direction so as to convert them into the final projection beam (204). As a result of this special lens arrangement, the short-throw projector projects images within a relatively short distance and in a direction that is different from that of the initial beam. A short-throw projector is used in the invention in order to make possible the projection from a point that is raised above the maze passage arch.

Figure 3:
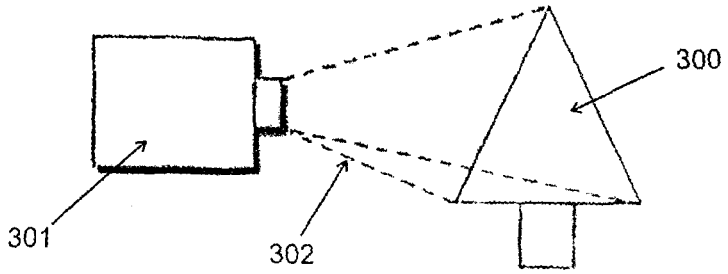
FIG. 3 shows a detail that defines the technology according to the prior art of projection mapping or image projection within a specific contour defined by a mask, and wherein the video content can be projected onto an object with multiple edges.

FIG. 3 shows a projector (301) that projects an image within a specific contour (300) of an object with a random shape and a texturized planar surface, wherein the video projector has a remote control allowing its adjustment within parameters such as the projection angle and height, et cetera. The content has been previously configured to project only within the contour of the object in order to display video content (302) on the desired surface. The shape of the object to be projected is created utilizing a computer aided design (CAD) program with the use of a computer numerical control (CNC) program, wherein the personnel of the establishment can control the duration and image to be displayed as suitable for the particular moment. The same form of data is used to delineate the object and configure the projection thereon, wherein the edges of the object are formed, the object is formed using a template or reticle, the template masks the data, and the image is projected within the contours defined by the mask.

FIG. 4*a* shows an arch (400) according to the prior art, which is provided with an impression (41) and overhead lighting (403) by means of LEDs that change colors, wherein the arch consists of a perimeter surface (401) attached to the pillars or posts by the vertical edges; said surface is imprinted with motifs that are repeated on both the front and rear surfaces of each frame along the entire maze; the space (402) defines the passage through the latter in order to obtain access to the subsequent basic triangular cell within the maze, and also defines the space to be covered with a mirror in order to present an obstacle that prevents the passage of the spectator, and the mirror has a plurality of reflections that confuse the spectator. The basic cell is formed by three arches in a triangular arrangement at 60° angles to each other—that is, they form equilateral triangles—wherein one cell has at least one passage and at least one mirror; more specifically, it can contain two passages and one mirror or two mirrors and one passage. FIG. 4*b* shows an arch (405) of an embodiment of the invention that does not have an impression, wherein the lighting is provided by the projection (502) from the overhead projector (408) per se, and the shape of the arch is the same as that according to the prior art, but the impression is replaced by an opaque surface with a pale and solid color, and the reflecting surfaces, including the surface of the support post or pillar, are also replaced; the new arch, whose perimeter surfaces are modified to convert them into opaque or reflecting surfaces, comprises a perimeter surface (406) attached by the vertical edges to the pillars or posts, whose surface is smooth, opaque, and pale in color, and which makes possible the projection of images (407) thereon; the front and rear surfaces of each frame can be opaque or can be alternatively a front opaque surface and a rear reflecting surface, as required, along the entire maze; the space (402) defines a portal for passage or a space for placement of a mirror, through which access is obtained to the subsequent basic triangular cell within the maze, and which also defines a space to be covered with a mirror in order to present an obstacle that prevents the passage of the spectator, wherein the mirror presents a plurality of reflections that confuse the spectator. The basic cell is formed of three arches in triangular arrangement at 60° angles to each other—that is, forming equilateral triangles—wherein a cell has at least one passage and at least one mirror; more specifically, it can contain two passages and one mirror or two mirrors and one passage. The internal surfaces of the basic cell, which are located opposite to the projection surface, are covered with reflecting vinyl in this embodiment in order to convert the entirety of the arch into a mirror, wherein even the post sections or internal surfaces of the pillars are also lined with reflecting vinyl or a mirror in order to prevent black or reflection-free sections in the multiple reflections that generate the effect of straight line tunnels, which are characteristic of triangular arrangements of the basic cells of mazes with arches arranged at 60° angles to each other. The conversion of the other two arches that comprise the basic cell into mirrors has the objective of preventing an excessive expense on projectors, as, if the arches were not reflecting, it would be necessary to use three projectors for each cell. There exists a case in which it is necessary to project on both surfaces of the passage arch; this occurs when it is necessary to change the direction of the beam to be reflected. The opaque or reflecting projection surface (406) is generally positioned within a passage arch or portal—that is, the arch that does not comprise a mirror; an animated (407) projected image (502)—which is even provided with a sound congruent with said projection and can relate to a subject, an advertisement, or general information—is directed onto the opaque perimeter surface. The subject of the projection may be related to suspense, terror, the sky, drama, cartoons, documentaries, et cetera.

FIG. 5 is a view that shows the triangular shape of the basic cell (505) of the maze, which has at least one passage portal and at least one mirror, wherein the cell is supported by means of three pillars (60), one positioned at each vertex. In this embodiment, the cell has an arch (405) with a passage portal on whose edge dynamic images (502) are projected; the arch (405) is joined to two other arches that have mirrors (500 and 501) in order to form a basic cell. The arch (405) with the passage portal has a white-colored opaque internal surface or projection frame on which the images (502) are projected; the internal surfaces of the arches (500 and 501) opposite to the projection frame have been lined with reflecting paper or adhesive vinyl; this includes the lined flat internal section of the support posts (60) that join and support the panels that comprise the arches of the maze. The dotted line indicates a passage portal—that is, a panel without an obstacle or mirror—while the load-bearing arches (500 and 501) create natural obstacles complemented by the mirrors that create important disorientation in the spectator; these obstacles are arranged at 60° angles to each other.

FIG. 6 represents the visual trajectory of the different passageways in the succession of basic cells in an arrangement of mirrors of the projection section of a maze, with one trajectory represented by a dotted line (11) and another reflection trajectory represented by a continuous line (12), which define the lines of vision (11 and 12) and additionally mark the trajectory along which the short-throw projectors are placed; these project the same dynamic image in a synchronized manner within each projection arch; the dynamic projected image is reflected in the complementary mirrors of the triangular cells comprising the maze; the effect of projection on all the arches is created when just the surface of the passage portal is provided with a projection. FIG. 6 shows just the section receiving the projection, which leaves open the possibility of a mixed maze with a section of imprinted arches and a section with arches receiving animated projections. Reference character (S) indicates the exit of the maze, in this case the final section of the projection.

FIG. 7 shows thick lines (1) that indicate the plurality of arches upon which the dynamic images of this invention are projected, which generally correspond to the line of vision that starts at the entrance (E) and ends at the exit (S), in particular for the embodiment of the invention outlined in FIG. 7, wherein short-throw projectors 22 to 24 are placed in such a manner as to project images with changing colors on all the cells and to provide background music; this creates an attraction that constantly changes depending on the manner in which the image is delimited or masked to project onto a defined projection contour or mapping, wherein the images are projected at will with changes in shape, colors, sounds, et cetera.

An important advantage to be attained with the invention was the selection of a suitable projector that would project from above the arch in order to avoid the shadow of the spectator as he passes under the portal. A short-throw projector was found to be a suitable device, as the projection angle located within the interval of 30 to 40 degrees was immediately resolved; however, the projection required another modification, as the panel of the arch was flat and elongated, making it necessary to hold the short-throw projector in a vertical position or on its side by means of supports, which in most cases emerge from the ceiling; however, the projector must be affixed to the upper end of the post or pillar by means of an aerial support when it is not possible to affix it to the ceiling; this allows the projector to be moved up, down, and along a horizontal plane so that the exact position for projection can be reached with this support in order to completely cover the desired contour of the arch. Without the projection arrangement over one face of the arch and the reflective lining of the complementary angles that form the basic cell, it would be necessary to use three short-throw projectors for each cell in order to achieve the projection and reflection effect with a single projector; that is, the reflection is projected onto the passage arch or portal lined with white or pale opaque vinyl, and the other arches are lined with reflecting vinyl or a mirror, as are the columns that support the arch, which are also lined with reflecting vinyl, but the projection or opaque arches and those with mirrors must be defined, for which purpose the line of vision mentioned in FIG. 6 is used. The reflection is projected on just one arch of the basic cell, and the other two arches are mirrored; in another embodiment it is necessary to project onto the front and rear surface of a cell with image return.

FIG. 8 shows a schematic of the dynamic projection area of the maze, in which the vertices are highlighted that form the reflecting panels (2) in front of the projection panel (1) and that jointly form the basic cell of the maze, wherein a reflection of the aforementioned visual trajectory shall be imminently present on any mirror belonging to any of the vertices; said trajectory travels the distance from the entrance (E) to the exit (S) of the projection section, creating the reflections needed to create the effect of tunnels through the use of dynamic projection onto and lighting of the reflection and passage arches.

FIG. 9 shows a view of a maze according to the prior art, in which the imprinted arches (41) function as a support or decorative element of the mirrors (42), and the arch is attached in turn to the posts or pillars (40), which are attached in turn to the floor (43), and lines that emerge from each pillar (40) are drawn on the floor and additionally define the shape of each basic cell. The impression of the arches (41) is illuminated by means of overhead lights emitted by LED lamps located in the center of the ceiling of each cell.

FIG. 10 shows three embodiments of the projection (407) onto the arches (406) according to the invention, whose image is projected within the contour (54) and is reflected in the mirror (53) to be subjected to multiple reflections.

FIG. 11 shows the preparation of the basic cell in that the impression of the arch is completely lined with pale, opaque vinyl (61) and (62), whose arch is attached to the pillar (60), which in turn supports the reflecting arch (64), whose lower edge (63) is lined with reflecting vinyl in order to obtain a total reflection. In this embodiment of the invention, the arches consist of a succession of clear portals lined with opaque vinyl and reflecting vinyl, including the corresponding sections of the pillar that function as attachment elements.

The invention claimed is:

1. A mirror maze with dynamic animation for projection onto an arch, comprising:

a mirror arrangement with basic cells in the shape of an equilateral triangle with arches that create obstacles by means of mirrors; the arrangement is provided with at least one mirror and at least one passage portal, wherein the arches are delimited by a vertical panel and define a projection contour;

three support posts or pillars in each cell for the portal panels, which allow the passage of the spectator, or in which mirrors are placed in order to form obstacles that prevent passage;

a level floor on which lines are imprinted that join the posts or pillars;

a plurality of basic cells in triangular shape, with at least one projection arch contour lined with opaque vinyl and two reflecting arch contours lined with reflecting vinyl, which includes the interior panel section of each pillar; and a plurality of short-throw projectors placed on their sides in order to allow projection onto an entire basic cell, which is accomplished by delimiting the projection by utilizing a mask that delimits the contours of the arches of the basic cell, with lighting and sound effects integrated into the projection of the image.

2. The mirror maze with dynamic animation for projection onto an arch according to claim 1, wherein each basic cell has at least one opaque arch and two reflecting arches, wherein said reflecting arches are positioned opposite to said opaque arch.

3. The mirror maze with dynamic animation for projection onto an arch according to claim 2, wherein the projection is made onto the mutable surface of the passage portal or the portal lined with pale opaque vinyl, and the other cell arches are lined with reflecting vinyl or a mirror.

4. The mirror maze with dynamic animation for projection onto an arch according to claim 1, wherein the images are projected within the specific contour of each arch without producing a shadow as the spectator passes.

5. The mirror maze with dynamic animation for projection onto an arch according to claim 1, wherein each basic cell has at least one projector directed toward the contour of the passage portal.

6. The mirror maze with dynamic animation for projection onto an arch according to claim 1, wherein the image projection is synchronized in order to project the same image onto all the arches of the maze.

7. The mirror maze with dynamic animation for projection onto an arch according to claim 1, wherein the projection consists of animated images with sound and lighting.

8. The mirror maze with dynamic animation for projection onto an arch according to claim 1, wherein each projection arch has a pair of reflecting arches.

9. The mirror maze with dynamic animation for projection onto an arch according to claim 1, wherein the projectors are placed along the line of vision of the reflections.

10. The mirror maze with dynamic animation for projection onto an arch according to claim 1, wherein the angle of projection is located within the interval between 32 and 35 degrees.

11. The mirror maze with dynamic animation for projection onto an arch according to claim 1, wherein the angle of projection is located within the interval between 30 and 40 degrees.

* * * * *